US007542700B2

(12) United States Patent
Kim et al.

(10) Patent No.: US 7,542,700 B2
(45) Date of Patent: Jun. 2, 2009

(54) IMAGE FORMING PROCESS MODULE HAVING A DETACHABLE WASTE DEVELOPER STORAGE TANK AND IMAGE FORMING APPARATUS HAVING THE SAME

(75) Inventors: Ho-dong Kim, Yongin-si (KR); Hae-seog Jo, Yongin-si (KR)

(73) Assignee: Samsung Electronics Co., Ltd., Gyeonggi-do, Suwon-si (KR)

( * ) Notice: Subject to any disclaimer, the term of this patent is extended or adjusted under 35 U.S.C. 154(b) by 106 days.

(21) Appl. No.: 11/434,226

(22) Filed: May 16, 2006

(65) Prior Publication Data

US 2007/0019985 A1 Jan. 25, 2007

(30) Foreign Application Priority Data

Jul. 22, 2005 (KR) ..... 10-2005-0066647

(51) Int. Cl.
*G03G 21/16* (2006.01)
*G03G 15/04* (2006.01)
*G03G 21/00* (2006.01)

(52) U.S. Cl. ..... 399/111; 399/119; 399/120; 399/123; 399/359; 399/360

(58) Field of Classification Search ..... 399/111, 399/119, 120, 123, 343, 350, 351, 358, 359, 399/360

See application file for complete search history.

(56) References Cited

U.S. PATENT DOCUMENTS 5,030,988 A 7/1991 Haneda
5,146,270 A 9/1992 Matsuo
5,327,208 A * 7/1994 Matsuo et al. ..... 399/112
5,579,086 A * 11/1996 Ikunami et al. ..... 399/112
5,956,556 A 9/1999 Nakajima
6,647,227 B2 11/2003 Yokoi
2003/0059230 A1 3/2003 Yokoi

FOREIGN PATENT DOCUMENTS

| | | |
|---|---|---|
| EP | 0 376 617 | 12/1989 |
| JP | 07-333946 | 12/1995 |
| JP | 2001-166666 | 6/2001 |
| KR | 1020010066798 | 7/2001 |
| KR | 2001-102849 | 11/2001 |

* cited by examiner

*Primary Examiner*—Hoang Ngo
(74) *Attorney, Agent, or Firm*—Roylance, Abrams, Berdo & Goodman, L.L.P.

(57) ABSTRACT

An image forming process module is provided having an integrated photoreceptor unit and development unit, and an image forming apparatus having the same. The image forming process module includes a photoreceptor unit having at least one photoreceptor on which an electrostatic latent image is formed. A development unit is installed around the outer surface of the photoreceptor and having a plurality of development assemblies for developing the latent image, thereby forming a visual image. A fixing frame is detachably installed to a main body of an image forming apparatus for fixing the photoreceptor unit and the development unit to be integrated into a single module. The image forming process module has the enhanced assembly and replacement efficiencies because the photoreceptor unit and the development unit are simultaneously installed to and uninstalled from a main body of an image forming apparatus as a single module.

30 Claims, 14 Drawing Sheets

IMAGE FORMING PROCESS MODULE HAVING A DETACHABLE WASTE DEVELOPER STORAGE TANK AND IMAGE FORMING APPARATUS HAVING THE SAME

CROSS-REFERENCE TO RELATED APPLICATIONS

This application claims the benefit under 35 U.S.C. § 119 (a) of Korean Patent Application No. 2005-66647, filed Jul. 22, 2005 the entire contents of which are hereby incorporated by reference.

BACKGROUND OF THE INVENTION

1. Field of the Invention

The present invention relates to an image forming apparatus, such as a color printer or a color copier. More particularly, the present invention relates to an image forming process module in which a photoreceptor unit and a development unit are integrated, and an image forming apparatus having the same.

2. Description of the Related Art

Referring to FIG. 1, a conventional image forming apparatus 10, such as a color printer or a color copier, includes a photoreceptor 11 configured like a drum and is continuously rotated in one direction, such as clockwise, by a photoreceptor driving motor (not shown).

Around the circumferential outer edge of the photoreceptor 11, an electrification unit 12, a laser scanning unit (LSU) 20, a development unit 30, an image transfer unit 60, a charge-removing lamp 87 and a cleaning and charge-removing unit 80 are disposed in order in the direction of rotation of the photoreceptor 1.

The electrification unit 12 includes a scorotoron electrifier and electrifies the photoreceptor 11 uniformly. The LSU 20 exposes the photoreceptor 11 to a light source, such as a laser diode, to form a latent image.

The development unit 30 includes four development assemblies 31, 32, 33 and 34 having yellow (Y), magenta (M), cyan (C) and black (K) developers, respectively, therein.

Each of the development assemblies 31, 32, 33 and 34 includes a developer storage part 16, a development roller 13, a developer supply roller 15 and a blade 51 serving as a developer layer limitation member for limiting the thickness of a developer layer attached on the developer roller 13. Such components constituting each development assembly are integrated into a single body so that each of the development assemblies 31, 32, 33 and 34 is replaced with a new one as a whole when the lifespan of any component of each development assembly 31, 32, 33 and 34 is ended. The developments assemblies 31, 32, 33 and 34 are installed into a main frame or a fixing frame (not shown) of a main body of an image forming apparatus.

The developer storage part 16 is structured to be sealed so that a new developer cannot be refilled. Alternatively, the developer storage part 16 can be structured to have a detachable developer cartridge so that a developer can be refilled when the developer in the developer storage part 16 is depleted simply by replacing the old developer cartridge with a new one. The developer stored in the developer storage part 16 is supplied to the development roller 13 by the developer supply roller 15 of the development storage part 16, which is supplied with a bias voltage. Furthermore, the thickness of the developer on the development roller 13 is limited by the blade 51, which applies a predetermined charge injection voltage to the developer on the development roller 13.

The development roller 13 and the developer supply roller 15 are driven to rotate by a development unit gear train (not shown) connected to a photoreceptor drive motor.

In each development assembly 31, 32, 33 and 34, a development bias voltage supply unit is provided between the development roller 13 and a high voltage power source (not shown). The development bias voltage supply unit changes a voltage supplied from the high voltage power source to a predetermined development bias voltage and supplies the development bias voltage to the development assemblies 31, 32, 33 and 34 in turns.

The image transfer unit 60 elastically transfers a color developer image formed in the photoreceptor 11 onto an image reception medium P, such as a record paper. The cleaning and charge removing unit 80 removes the developer remaining in the photoreceptor 11.

The conventional image forming apparatus 10 has the following disadvantages.

First, because the conventional image forming apparatus 10 stated above is structured to have the photoreceptor 11 and the development assemblies 31, 32, 33 and 34 of the development unit 30 that are realized as separate components, it requires significant time and labor to manufacture the image forming apparatus or to replace components thereof, resulting in low assembly and replacement efficiency.

Second, because the conventional image forming apparatus 10 stated above is structured to have the photoreceptor 11 and the development assemblies 31, 32, 33 and 34 of the development unit 30 that are realized as separate components, sizes of the components should be severely designed and managed to make each component precisely organized and smoothly detached. Accordingly, it is difficult to manufacture the image forming apparatus.

Third, when the developer storage part 16 is structured to be sealed to not be refilled with a new developer, the development assemblies 31, 32, 33 and 34 should be designed to have a large size to increase replacement periods of the development assemblies 31, 32, 33 and 34 of the development unit 30. Accordingly, the development unit 30 has a large size and it is difficult to realize an image forming apparatus 10 having a compact size.

Accordingly, a need exists for an image forming apparatus having an integrated photoreceptor unit and development unit.

SUMMARY OF THE INVENTION

Accordingly, an aspect of the present invention is to provide an image forming process module in which a photoreceptor unit and a development unit having a plurality of development assemblies are integrated so that they are simultaneously installed to and detached from a main frame, thereby enhancing assembly and replacement efficiency, and an image forming apparatus having the same module.

According to another aspect of the present invention, an image forming process module has a plurality of developer cartridges that may be detachably installed in a development unit to increase developer refill efficiency, and there is further provided an image forming apparatus having the same module.

According to one exemplary embodiment of the present invention, the image forming process module for an image forming apparatus includes a photoreceptor unit having at least one photoreceptor on which an electrostatic latent image is formed. A development unit installed around the outer surface of the photoreceptor includes a plurality of development assemblies that develop the latent image, thereby forming a visual image. A fixing frame detachably installed to a main body of an image forming apparatus fixes the photoreceptor unit and the development unit to be integrated into a single module.

The photoreceptor unit further includes a photoreceptor cleaner for cleaning the photoreceptor. The photoreceptor cleaner includes a cleaning member for cleaning the surface of the photoreceptor, and a waste developer storage part for storing waste developer generated as the cleaning member cleans the photoreceptor. The waste developer storage part has a waste developer collector installed under a side of the photoreceptor for collecting waste developer removed by the cleaning member. A waste developer storage tank is detachably installed to the fixing frame for storing the waste developer collected in the waste developer collector. A waste developer transfer member transfers the waste developer collected in the waste developer collector to the waste developer storage tank.

Preferably, the waste developer transfer member includes a waste developer transfer auger for moving the waste developer collected in the waste developer collector to a side of the waste developer collector. A connection pipe line connects the waste developer collector with the waste developer storage tank. A waste developer transfer belt installed in the connection pipe line transfers the waste developer from the waste developer collector to the waste developer storage tank.

The image forming process module may further include a waste developer cartridge unit including a plurality of developer cartridges, each of which contains a different color developer from each other and each being detachably installed to a cartridge fixing part, which is fixed to the fixing frame to be connected to each corresponding development assembly.

Each of the developer cartridges has a storage vessel that contains a developer and has a developer discharge part that discharges the developer to the corresponding development assembly. A rotational shaft is rotatably supported by the storage vessel. A mixing member mixes the developer in the storage vessel.

Each development assembly may further include a developer transfer member for transferring a developer discharge from the developer discharge part of the storage vessel to a developer supply roller.

Preferably, the developer transfer member has a developer transfer belt for transferring a developer dropped from the developer discharge part of the storage vessel to the developer supply roller. At least one developer transfer auger is installed between the developer supply roller and the developer transfer belt for transferring a developer in the direction of length of the developer supply roller.

The developer cartridge unit may further include a cartridge drive force transfer part for transferring a drive force to the rotational shaft of each developer cartridge. Preferably, the cartridge drive force transfer part includes a first drive force transfer gear engaged with a drive gear train installed to the main body. A second drive force transfer gear is engaged with the first drive force transfer gear. A plurality of worms are formed on the same shaft of the second drive force transfer gear. A plurality of worm gears are engaged with the worms and corresponding rotation gears formed on the rotational shafts of the developer cartridges, respectively.

The image forming process module may further include a lock part for locking the image forming process module to the main body of the image forming apparatus when the image forming process module is mounted on the main body of the image forming apparatus. Preferably, the lock part includes a hook member installed in the fixed frame such that the hook member moves between a first position at which it is inserted into a fixing hole of the main body and a second position at which it is separated from the fixing hole. An elastic member elastically presses the hook member so that the hook member is kept in the first position. An operation member moves the hook member to the second position so that the hook member is separated from the fixing hole.

Alternatively, the image forming process module may further include a guide part for guiding a motion of the image forming process module when the image forming process module is mounted on or separated from the main body of the image forming apparatus. Preferably, the guide part includes a plurality of rotation rollers rotatably installed on the bottom of the fixing frame.

According to another aspect of the present invention, an image forming apparatus includes a main frame constituting a main body, and an image forming process module including a photoreceptor unit having a developer on which an electrostatic latent image is formed. A development unit is installed around an outer edge portion of the photoreceptor and has a plurality of development assemblies for developing the electrostatic latent image and forming a visual image. A fixing frame is detachably installed to the main frame for fixing the photoreceptor unit and the development unit to be integrated into a single module.

The photoreceptor unit further includes a photoreceptor cleaner for cleaning the photoreceptor. The photoreceptor cleaner has a cleaning member for cleaning the surface of the photoreceptor. A waste developer storage part stores waste developer generated as the cleaning member cleans the photoreceptor. The waste developer storage part has a waste developer collector installed under a side of the photoreceptor for collecting waste developer removed by the cleaning member. A waste developer storage tank is detachably installed to the fixing frame for storing the waste developer collected in the waste developer collector. A waste developer transfer member transfers the waste developer collected in the waste developer collector to the waste developer storage tank.

Preferably, the waste developer transfer member includes a waste developer transfer auger for moving the waste developer collected in the waste developer collector to a side of the waste developer collector. A connection pipe line connects the waste developer collector with the waste developer storage tank. A waste developer transfer belt installed in the connection pipe line transfers the waste developer from the waste developer collector to the waste developer storage tank.

The image forming apparatus further includes a waste developer cartridge unit including a plurality of developer cartridges, each of which contains a different color developer from each other and each being detachably installed to a cartridge fixing part fixed to the fixing frame to be connected to each corresponding development assembly.

Each of the developer cartridges includes a storage vessel that contains a developer and has a developer discharge part that discharges the developer to the corresponding development assembly. A rotational shaft is rotatably supported by the storage vessel. A mixing member mixes the developer in the storage vessel.

Each development assembly further includes a developer transfer member for transferring a developer discharge from the developer discharge part of the storage vessel to a developer supply roller.

Preferably, the developer transfer member has a developer transfer belt for transferring a developer dropped from the developer discharge part of the storage vessel to the developer supply roller. At least one developer transfer auger is installed between the developer supply roller and the developer transfer belt for transferring a developer in the lengthwise direction of the developer supply roller.

Furthermore, the developer cartridge unit further includes a cartridge drive force transfer part for transferring a drive force to the rotational shaft of each developer cartridge. Preferably, the cartridge drive force transfer part has a first drive force transfer gear engaged with a drive gear train installed to the main body. A second drive force transfer gear is engaged with the first drive force transfer gear. A plurality of worms are formed on the same shaft of the second drive force transfer gear. A plurality of worm gears are engaged with the worms and corresponding rotation gears formed on the rotational shafts of the developer cartridges, respectively.

The image forming process module may further include a lock part for locking the image forming process module to the main body of the image forming apparatus when the image forming process module is mounted on the main body of the image forming apparatus. Preferably, the lock part includes a hook member installed in the fixed frame such that the hook member moves between a first position at which it is inserted in a fixing hole of the main body and a second position at which it is separated from the fixing hole. An elastic member elastically presses the hook member so that the hook member is kept in the first position. An operation member moves the hook member to the second position so that the hook member is separated from the fixing hole.

Alternatively, the image forming process module may further include a guide part for guiding a motion of the image forming process module when the image forming process module is mounted on or separated from the main body of the image forming apparatus. Preferably, the guide part has a plurality of rotation rollers rotatably installed on the bottom of the fixing frame.

Other objects, advantages, and salient features of the invention will become apparent from the detailed description, which, taken in conjunction with the annexed drawings, discloses preferred exemplary embodiments of the invention.

BRIEF DESCRIPTION OF THE DRAWING FIGURES

The above aspect and other features of the present invention will become more apparent by describing in detail exemplary embodiments thereof with reference to the attached drawing figures, wherein.

Throughout the drawings, like reference numerals will be understood to refer to like parts, components and structures.

DETAILED DESCRIPTION OF EXEMPLARY EMBODIMENTS

Exemplary embodiments of the present invention are described in detail with reference to the annexed drawings. In the following description, detailed descriptions of known functions and configurations incorporated herein have been omitted for conciseness and clarity.

Figure 1:
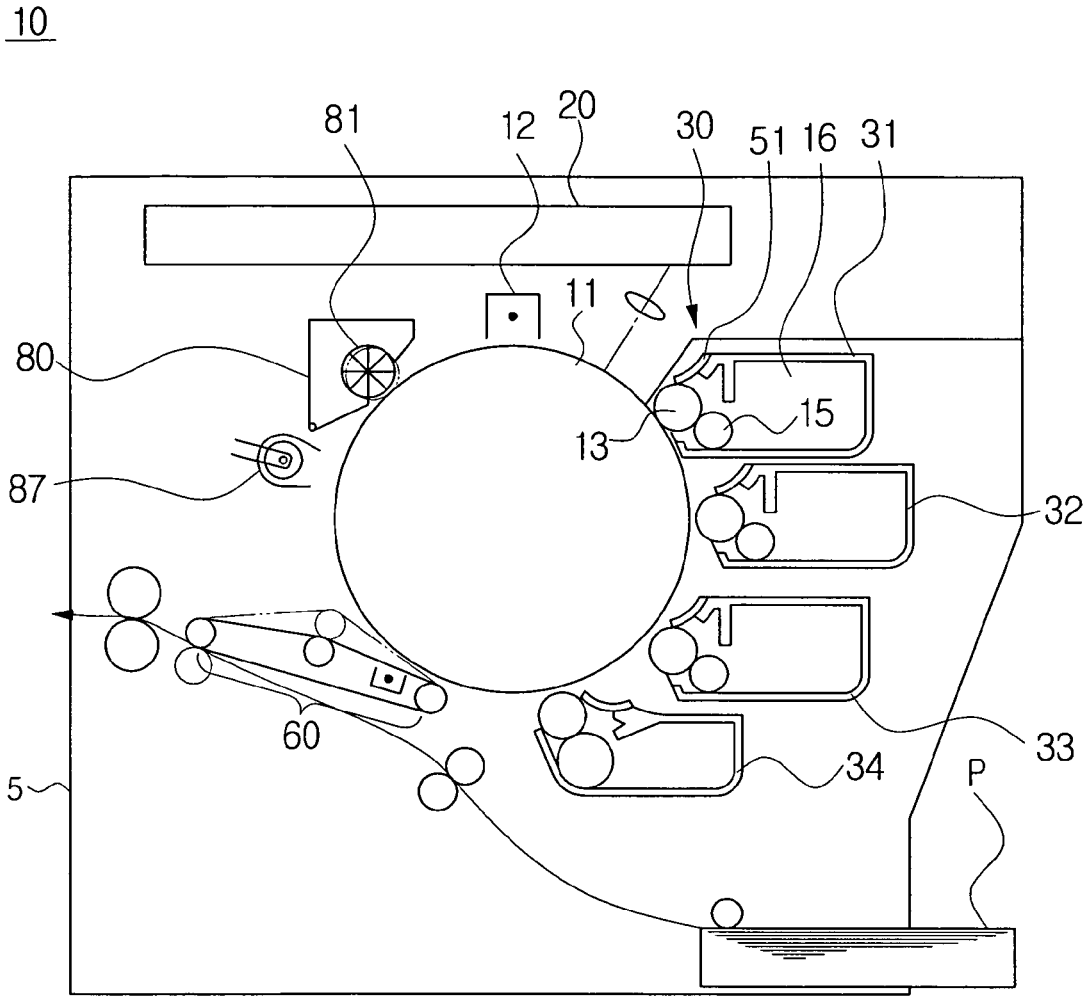
FIG. 1 (PRIOR ART)
FIG. 1 is a schematic view illustrating a conventional color image forming apparatus.
Figure 2:
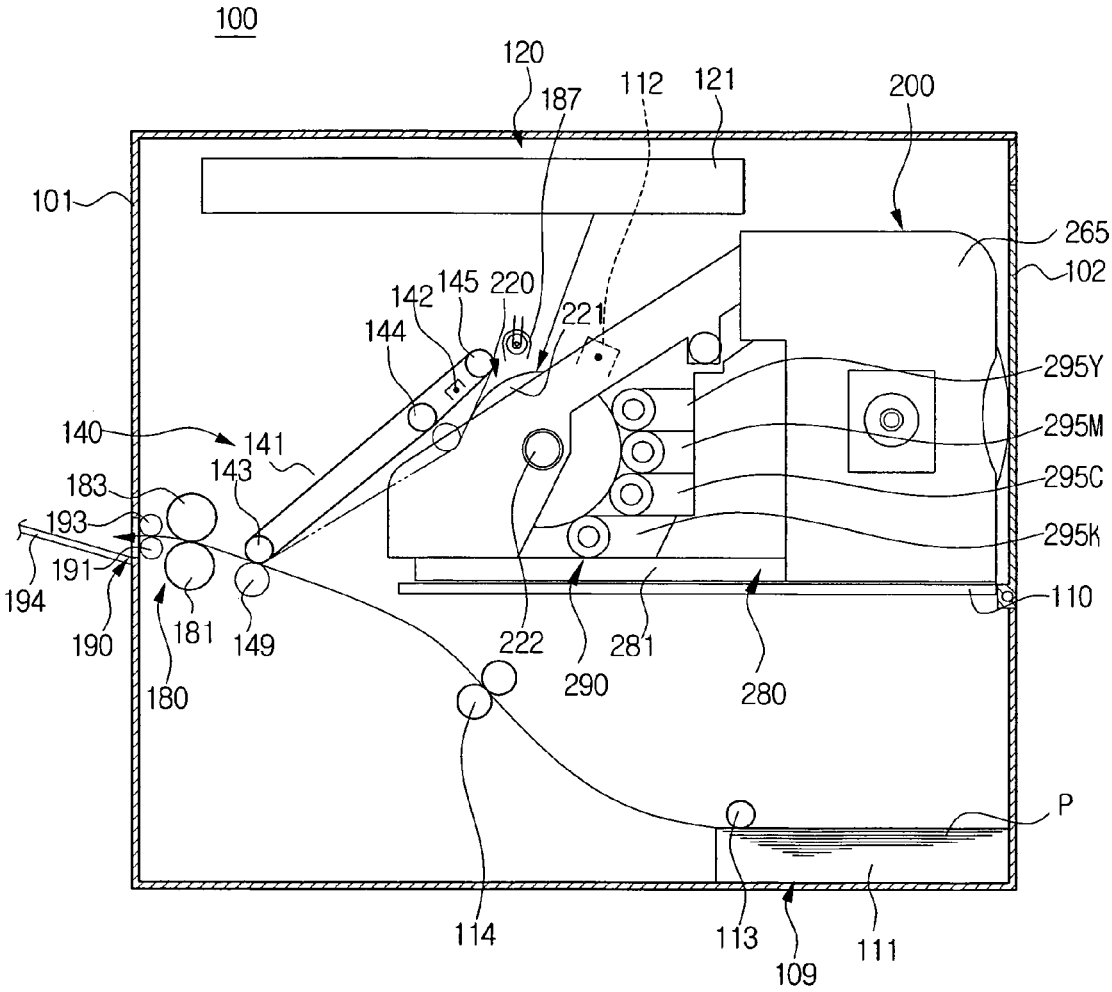
FIG. 2 is a schematic view illustrating an electro-photographic color printer having an image forming process module according to an exemplary embodiment of the present invention.

FIG. 2 illustrates an image forming apparatus having an image forming process module according to an exemplary embodiment of the present invention.

The image forming apparatus according to an exemplary embodiment of the present invention is an electro-photographic color printer 100 for processing image data transferred from a device, such as a computer (not shown) or a scanner (not shown), and conducting a print.

Referring to FIG. 2, the electro-photographic color printer 100 includes a paper feeding unit 109, an image forming unit 120, an image transfer unit 140, a fixing unit 180 and a paper discharge unit 190.

The paper feeding unit 109 feeds the image reception medium P, such as a record paper. The paper feeding unit 109 includes a paper feeding cassette 111, a pick-up roller 113, and a resist roller 114. The paper feeding cassette 111 picks up the image reception medium P loaded on the paper feeding cassette and transfers the image reception medium P to the resist roller 114.

The image forming unit 120 is arranged above the paper feeding unit 109 and forms a color developer image, such as a cyan (C) image, a magenta (M) image, a yellow (Y) image and a black (K) image, on the image reception medium P.

Figure 3:
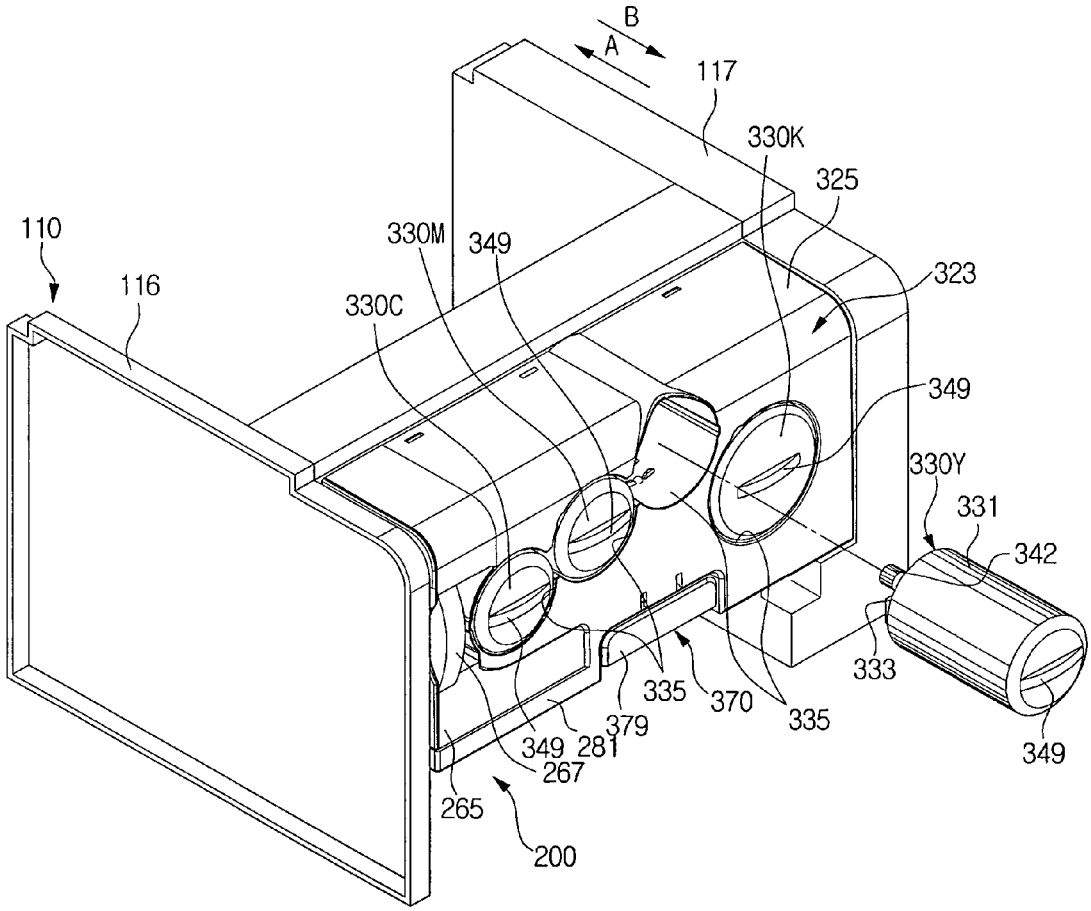
FIG. 3 is a perspective view of the image forming process module installed to a main frame of the electro-photographic color printer of FIG. 2.
Figure 4:
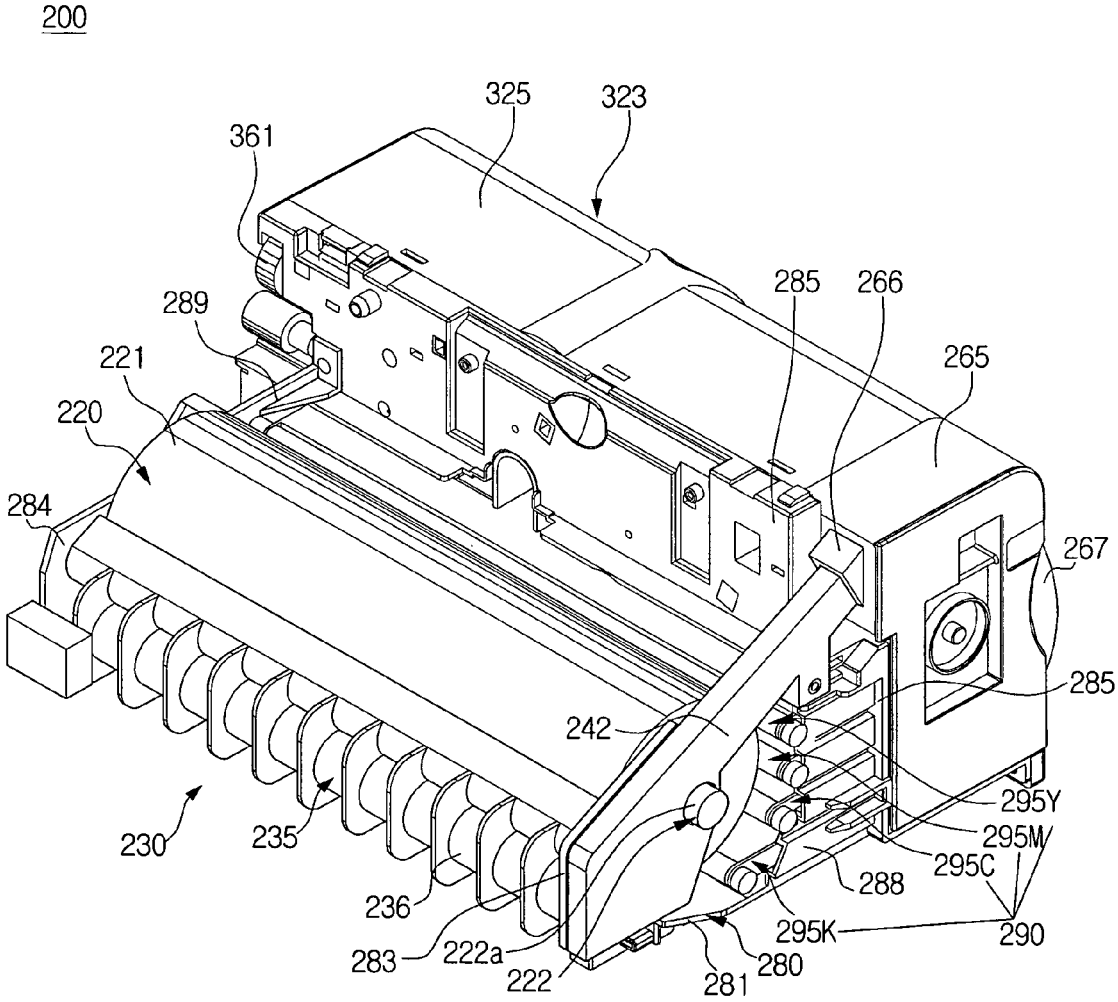
FIG. 4 is a perspective view of the image forming process module of the electro-photographic color printer of FIG. 2.

The image forming unit 120 includes an image forming process module 200 according to an exemplary embodiment of the present invention. Referring to FIG. 3 and FIG. 4, the image forming process module 200 is detachably installed to a main frame 110 of a main body 101 of an image forming apparatus and includes a photoreceptor unit 220 and a development unit 290 that are fixed by a fixing frame 280, thereby being forming a module.

The photoreceptor unit 220 includes a photoreceptor 221. The photoreceptor 221 includes an organic photoconductive (OPC) drum having an aluminum cylinder. An organic photoconductive layer is coated on the aluminum cylinder. Both ends of the photoreceptor 221 are coupled to a first flange 283 and a second flange 284, respectively, formed on a bottom plate 281 of the fixing frame 280, thereby being rotatably supported on the bottom plate 281. The photoreceptor 221 is arranged to form a nip by being in contact with an image transfer belt 141 at a substantially uniform pressure by a tension roller 144 of the transfer unit 140. The photoreceptor 221 is rotated in one direction, for example, counterclockwise, by a photoreceptor gear train (not shown) that receives a drive force from a drive gear train (108 in FIG. 14) of a photoreceptor drive motor (not shown) arranged in the main frame 110 of the main body 101. The structures of the drive gear train and the photoreceptor gear train are substantially similar to conventional drive gear trains and photoreceptor gear trains.

A photoreceptor cleaner 230 is disposed under a side (for example, to the left side in FIG. 4) of the photoreceptor 221 to clean the photoreceptor 221.

Figure 5:
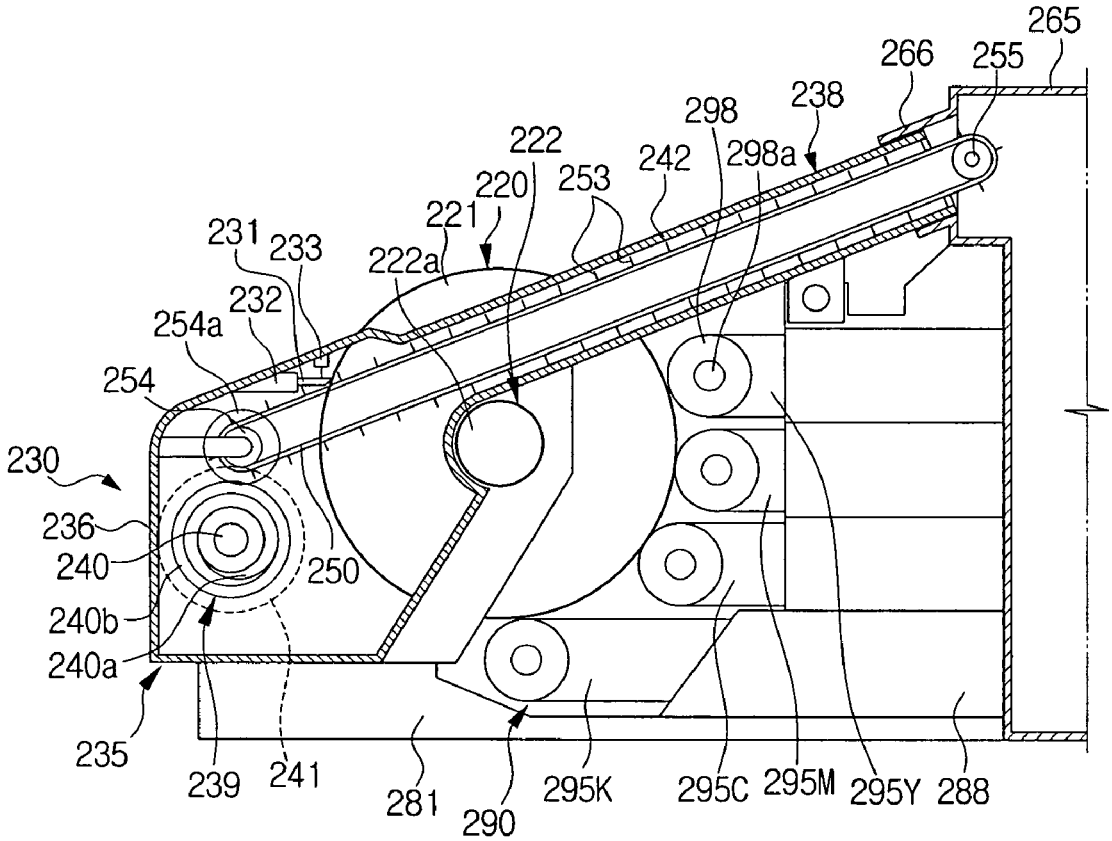
FIG. 5 is an elevational view in partial cross section of a waste developer storage part of a development unit of the image forming process module of FIG. 4.

Referring to FIG. 5, the photoreceptor cleaner 230 removes waste developer remaining on the surface of the photoreceptor 221 after a color developer image formed on the photoreceptor 221 is transferred to the image transfer belt 141 of the image transfer unit 140. The photoreceptor cleaner 230 includes a cleaning member 231, such as a cleaning blade, and a waste developer storage part 235.

The cleaning member 231 is pivotably installed to a fixed bracket 232 formed in a waste developer collector 236, and operates to contact or separate from the photoreceptor 221 at a predetermined pressure by a solenoid 233 when cleaning.

The waste developer storage part 235 stores waste developer removed from the surface of the photoreceptor 221 by the cleaning member 231, and includes the waste developer collector 236, a waste developer transfer member 238 and a waste developer storage tank 265.

The waste developer collector 236 is arranged to surround the whole length of the photoreceptor 221 under the photoreceptor 221 and collects waste developer removed by the cleaning member 231.

The waste developer transfer member 238 transfers waste developer collected in the waste developer collector 236 to the waste developer storage tank 265, and includes a waste developer transfer auger 239, a connection pipe line 242, and a waste developer transfer belt 250. The waste developer transfer auger 239 is arranged along the length of the waste developer collector 236 and includes a first auger shaft 240 having a helical projection 240*a* formed on the surface thereof to transfer the waste developer to a side of the waste developer collector 236. The first auger shaft 240 includes a first auger gear 241 connected to the photoreceptor gear train to be driven by the drive force from the photoreceptor drive motor. The connection pipe line 242 connects one side of the waste developer collector 236 to a waste developer introduction hole 266 formed at an upper portion of the waste developer storage tank 265 and guides a movement of waste developer when transferring the waste developer collected at a side of the waste developer collector 236 to the waste developer storage tank 265. The waste developer transfer belt 250 is disposed in the connection pipe line 242 and connected between a drive pulley 254 and a passive pulley 255. The drive pulley 254 includes a first pulley gear 254*a* connected to the second auger gear 240*b* formed at a side of the first auger shaft 240. The waste developer transfer belt 250 has a plurality of scoopers 253 formed like a compartment or a wing on the surface thereof to transfer the waste developer in the waste developer collector 236 to the waste developer storage tank 265.

The waste developer storage tank 265 is installed between a middle plate 285 and the bottom plate 281 at a side of a cartridge fixing part 325, which is described below, and stores waste developer transferred from the waste developer collector 236 by the waste developer transfer belt 250.

The introduction hole 266 of the waste developer storage tank 265 is detachably coupled to an end portion of the connection pipe line 242. The waste developer storage tank 265 includes a handle 267, which is held by a user when the user separates the waste developer storage tank 265 from the image forming process module 200. Accordingly, when the waste developer storage tank 265 is full, the entire image forming process module 200 does not need to be separated from the main body of the image forming apparatus and replaced with a new one to remove the waste developer in the waste developer storage tank 265. That is, the waste developer in the waste developer storage tank 265 is removed by separating only the waste developer storage tank 265 from the image forming process module 200 and emptying the waste developer storage tank 265, or replacing the waste developer storage tank 265 full with waste developer with an empty waste developer storage tank 265.

The development unit 290 is installed above the bottom plate 281 of the fixing frame 280 at a different side (the right side in FIG. 4) of the photoreceptor 221.

The development unit 290 includes a plurality of development assemblies, such as a yellow development assembly 295Y, a magenta development assembly 295M, a cyan development assembly 295C, and a black development assembly 295K, for developing an electrostatic latent image formed on the surface of the photoreceptor 221 by the LSU 121 and forming a visual image.

Figure 8A:
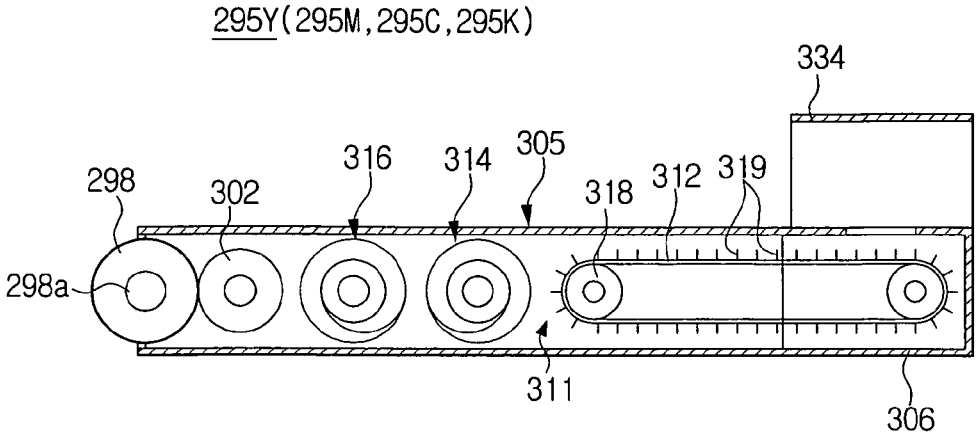
FIGS. 8A and 8B are an elevational view and a top plan view of an exemplary embodiment of the yellow development assembly of the development unit of FIG. 7.
Figure 8B:
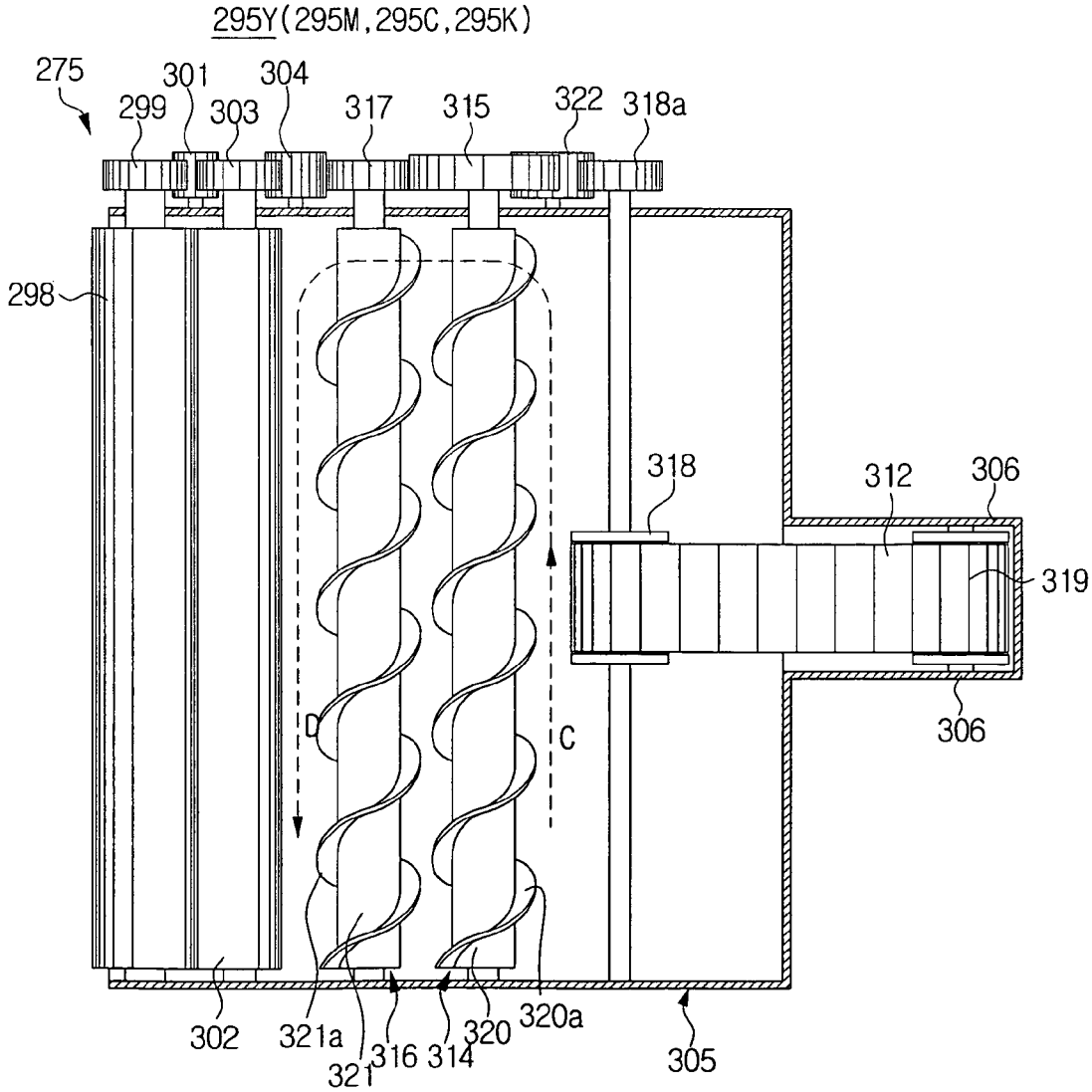

Referring to FIG. 8A and FIG. 8B, each development assembly 295Y, 295M, 295C and 295K includes a development roller 298, a developer supply roller 302 and a development assembly casing 305. Each of the development assemblies 295Y, 295M, 295C and 295K has a substantially similar configuration. Accordingly, only the yellow development assembly 295Y is described in detail as an example of the development assemblies 295Y, 295M, 295C and 295K.

The development roller 298 develops by attaching a developer onto the electrostatic latent image formed on the photoreceptor 221 by the LSU 121 while rotating in engagement with the photoreceptor 221. Accordingly, the development roller 298 is arranged to be close to the surface of the photoreceptor 221 and rotates in the direction to be engaged with the photoreceptor 221, for example clockwise, by a development roller gear 299 connected to the photoreceptor gear train for driving the photoreceptor 221. The development roller 298 is applied with a development bias voltage that is lower than that applied to the developer supply roller 302 from the development bias voltage supply unit (not shown).

The developer supply roller 302 supplies a developer to the development roller 298 using a potential difference between the development roller 298 and itself. The developer supply roller 302 is arranged to form a nip by being in contact with a portion of a side of the development roller 298. The yellow developer is transferred to a portion under the gap formed between the developer supply roller 302 and the development roller 298 in the casing 305.

The developer supply roller 302 rotates in the opposite direction of the development roller 298, for example clockwise, by the developer supply roller gear 303 connected to the development roller gear 299 that drives the development roller 298 via a first idle gear 301.

Furthermore, the developer supply roller 302 is applied with a predetermined developer supply bias voltage that is higher than that applied to the development roller 298. Accordingly, the developer disposed under the gap between the development roller 298 and the developer supply roller 302 is charged by receiving charges from the developer supply roller 302, attached to the development roller 298 which has a relatively low potential, and transferred to the nip between the developer supply roller 302 and the development roller 298.

Figure 6:
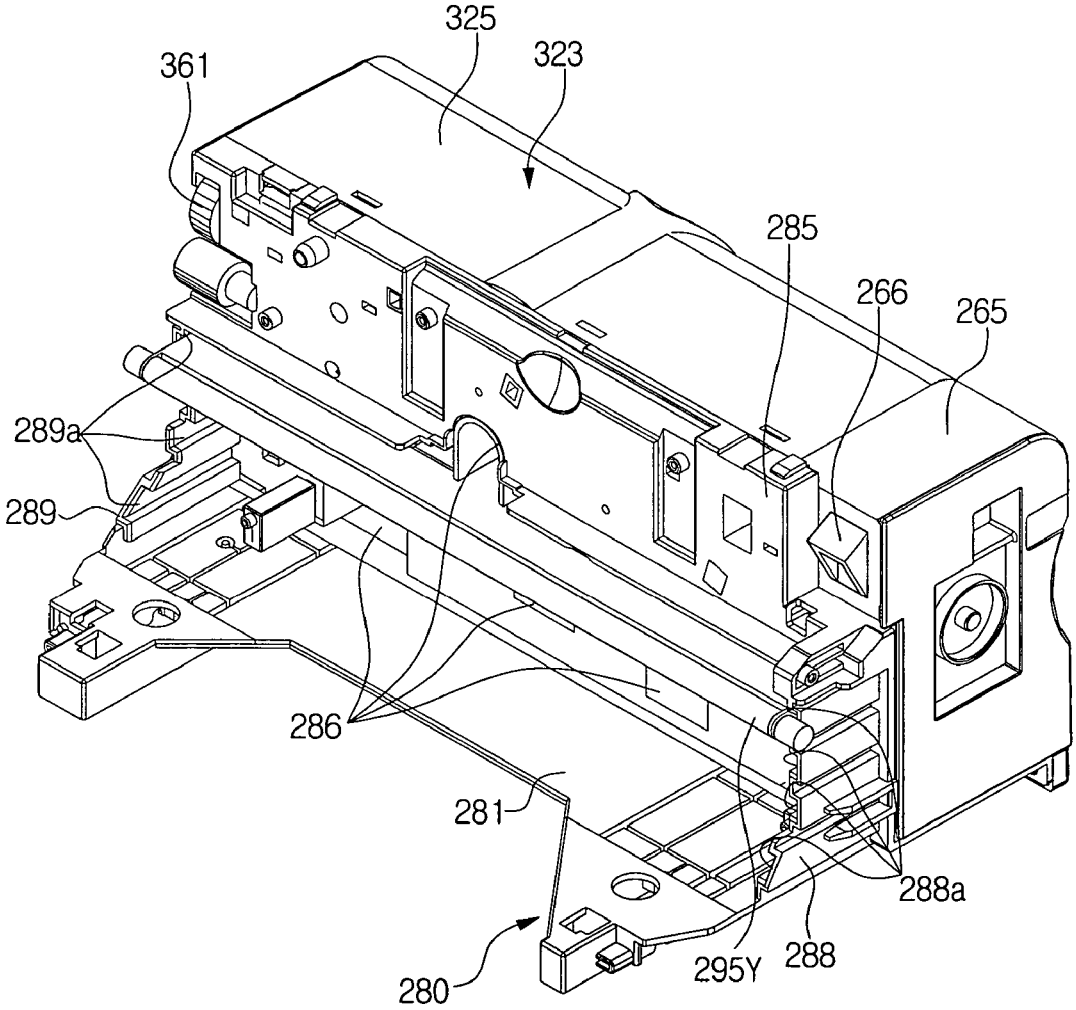
FIG. 6 is a perspective view of a yellow development assembly installed to a fixing frame of the development unit of the image forming process module of FIG. 4.

Referring to FIG. 6, the development assembly casing 305 encloses the development roller 298 and the developer supply roller 302, and has both ends fixed to and supported by a first and a second recess 288*a* and 289*a* formed in a first and a second development assembly reception bracket 288 and 289, respectively.

The development assembly casing 305 has a developer introduction part (306 in FIG. 8B) projected toward a cartridge fixing part 325, which will be described below, through an opening (286 in FIG. 6) formed in a middle plate 285 of the fixing frame 280.

Figure 7:
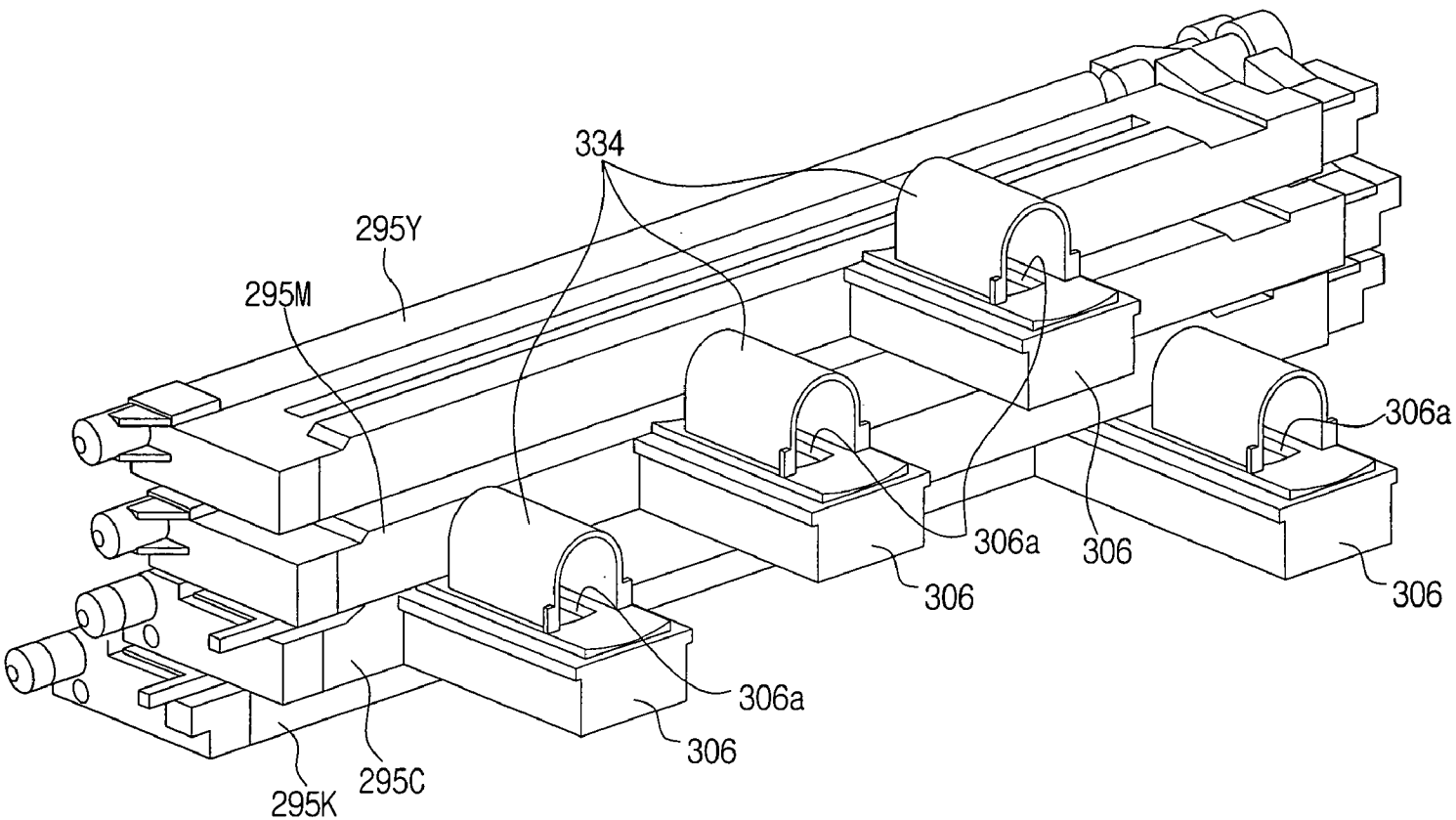
FIG. 7 is a perspective view of the developer introduction parts of the development assemblies of the development unit of the image forming process module of FIG. 4.
Figure 9:
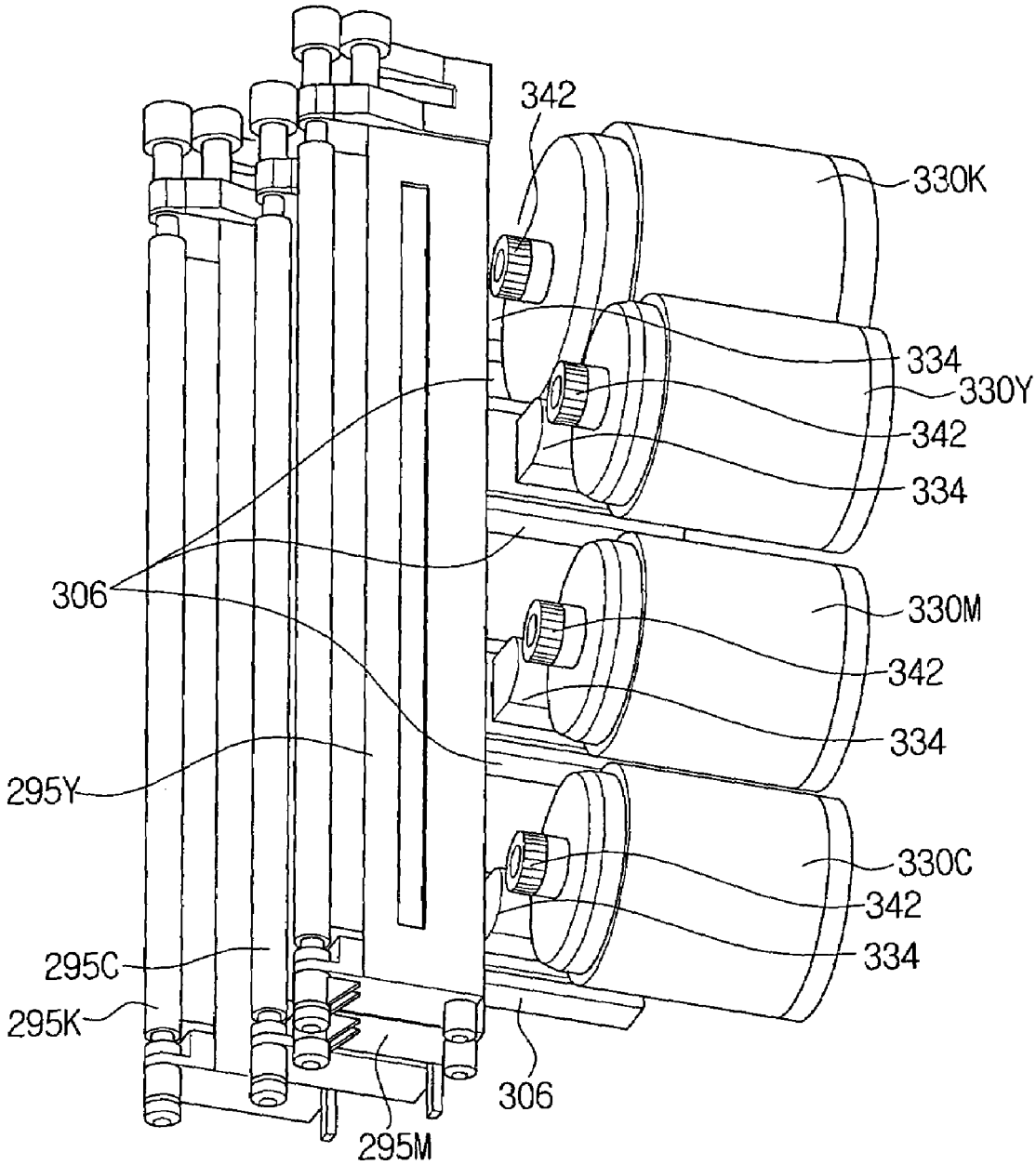
FIG. 9 is a perspective view of the image forming process module of FIG. 7 in which a development cartridge is installed in the development unit of the image forming process module.
Figure 10:
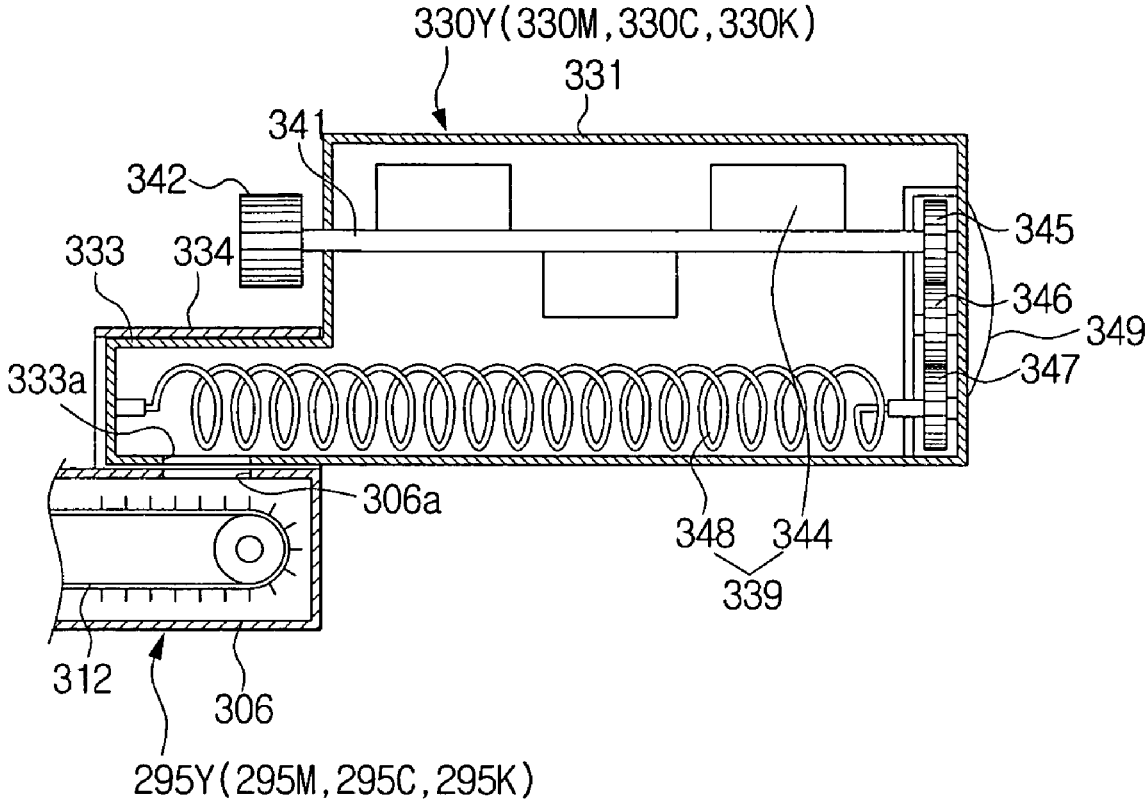
FIG. 10 is an elevational view in partial cross section of the coupling structure of the yellow development assembly and the developer cartridge of FIG. 9.

Referring to FIGS. 7, 9 and 10, at an upper portion of the developer introduction part 306, an introduction hole 306*a* is formed to be mated with a discharge hole 333*a* of a developer discharge part 333 of a storage vessel 331 of a yellow developer cartridge 330Y when the yellow developer cartridge 330Y is inserted in the recess 335 of the cartridge fixing part 325. Furthermore, at an upper portion of the introduction hole 306*a* of the developer introduction part 306, a substantially U-shaped fixing part 334 for receiving the developer discharge part 333 is formed.

Referring to FIG. 3 and FIG. 7, the developer introduction parts 306 of the development assembly casings 305 of the development assemblies 295Y, 295M, 295C and 295K are arranged to have a distance from each other so that vertical planes and horizontal planes of the developer cartridges 330Y, 330M, 330C and 330K, which pass through the centers of the casings 305, respectively are not to be in the same horizontal plane or in the same vertical plane when the developer cartridges 330Y, 330M, 330C and 330K are installed in the cartridge reception recesses 335 of the cartridge fixing part 325 to reduce a lateral and longitudinal size of a space occupied by the cartridges 330Y, 330M, 330C and 330K.

To smoothly supply yellow (Y), magenta (M), cyan (C) and black (K) developers from the yellow (Y), magenta (M), cyan (C) and black (K) cartridges 330Y, 330M, 330C and 330K to the development rollers 298, thereby preventing poor images from being formed caused by a deficiency in the amount of developers, referring to FIG. 8A and FIG. 8B, the development introduction parts 306 of the casings 305 of the development assemblies 330Y, 330M, 330C and 330K are provided with developer transfer members 311 for transferring the developers discharged from discharge holes 333*a* of the discharge parts 333 of the storage vessel 331 to the development rollers 302.

The developer transfer 311 includes a developer transfer belt 312, and a first and a second developer transfer auger 314 and 316.

The developer transfer belt 312 transfers a developer dropped from the discharge hole of the discharge part 333 of the storage vessel 331 to the supply roller 302, and is rotated counterclockwise by a second drive pulley 318 driven by a third and a fourth auger gear 315 and 317 via a third idle gear 322 and a second pulley gear 318*a*. The third and fourth auger gears 315 and 317 are driven by the developer supply roller gear 303 via a second idle gear 304. The developer transfer belt 312 has a plurality of second scoopers 319 on the outer surface thereof to transfer the developer dropped to under the belt to the first and second developer transfer augers 314 and 316.

The first and second developer transfer augers 314 and 316 are disposed away from each other by a distance and disposed between the developer supply roller 302 and the developer transfer belt 312. The first and second developer transfer augers 314 and 316 include second and third auger shafts 320 and 321, which have helical projections 320*a* and 321*a*, respectively on the outer surfaces thereof to transfer the developers in the direction of arrows C and D along a length of the developer supply roller 302. The first and second developer augers 314 and 316 are rotated in opposite directions to each other by the third and fourth auger gears 315 and 317, which are connected to the developer supply roller gear 303 via the second idle gear 304, so that the developer is transferred in the opposite directions C and D in the direction of length of the developer supply roller 302 by the first and second developer transfer augers 314 and 316, thereby forming a substantially U-shaped motion path.

The image forming process module 200 further includes a developer cartridge unit 323 having yellow (Y), magenta (M), cyan (C) and black (K) developer cartridges 330Y, 330M, 330C and 330K.

Referring to FIG. 3, the developer cartridges 330Y, 330M, 330C and 330K are detachably installed to the cartridge reception recesses 335 of the cartridge fixing part 325 configured like a box and formed on the bottom plate 281 of the fixing frame 280 to be connected to the corresponding development assemblies 295Y, 295M, 295C and 295K.

Referring to FIG. 10, each of the developer cartridges 330Y, 330M, 330C and 330K includes a storage vessel 331, a rotational shaft 341 and a mixing part 339.

The storage vessel 331 rotatably supports the rotational shaft 341 and stores a developer, such as cyan (C), magenta (M), yellow (Y) and black (K), having the same pole as toner. The storage vessel 331 includes a handle 349 that helps a user insert and separate the storage vessel 331 into and from the cartridge reception recess 335, and a discharge hole 333*a* through which the corresponding developer 295Y, 295M, 295C or 295K is discharged and introduced into the introduction hole 306*a* of the developer introduction part 306.

The rotational shaft 341 has a first rotation gear 342 engaged with a worm gear 368 of a cartridge drive force transfer part 360, which is described with reference to FIG. 11, when the storage vessel 331 is received in the cartridge reception recess 335.

The mixing part 339 includes a plurality of mixing blades 344 formed on the rotational shaft 341 supported by the storage vessel 331 and a scroll part 348 installed under the mixing blade 344. The scroll part 348 is rotationally driven by the scroll gear 347 connected to the second rotation gear 345 formed on the rotational shaft 341 via a fourth idle gear 346. Accordingly, when the rotational shaft 341 rotates, the mixing blades 344 mix the developer in the storage vessel 331 by circulation, and the scroll part 348 pushes the developer to the discharge part 333.

Figure 11:
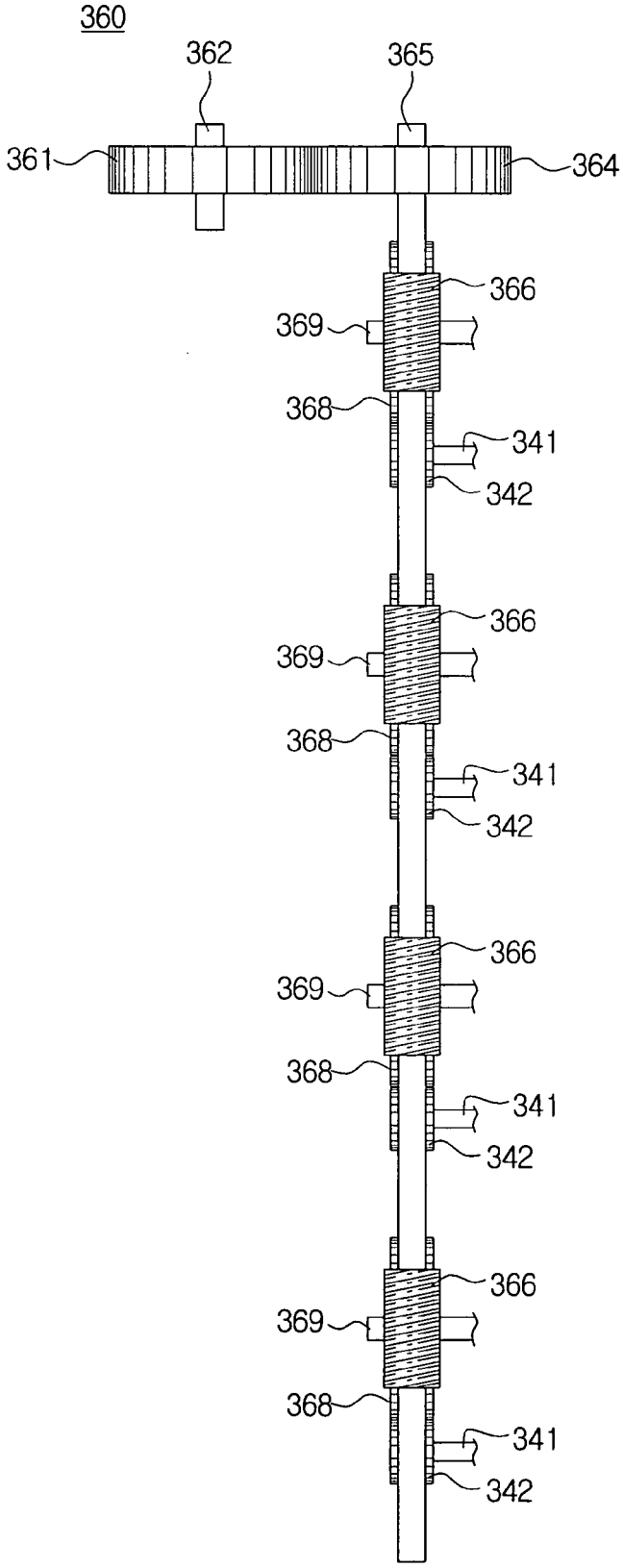
FIG. 11 is a top plan view of a cartridge drive force transfer part of a development cartridge unit of the image forming process module of FIG. 4.

Referring to FIG. 11, the developer cartridge unit 323 further includes a cartridge drive force transfer part 360 for transferring a drive force to rotational shafts 341 of the developer cartridges 295Y, 295M, 295C and 295K.

The cartridge drive force transfer part 360 includes a first drive force transfer gear (361 in FIG. 4 and FIG. 6), a second drive force transfer gear 364, a plurality of worms 366 and a plurality of worm gears 368.

The first drive force transfer gear 361 is formed on the first drive force transfer shaft 362 installed to the cartridge fixing part 325, and engaged with the drive gear train (108 in FIG. 14) installed to the main frame 110 when the image forming process module 200 is mounted on the main frame 110.

The second drive force transfer gear 364 is formed at an end portion of a second drive force transfer shaft 365 installed to the cartridge fixing part 325 with an inclination angle.

The worms 366 are formed on the second drive force transfer shaft 365 at regular intervals, and the worm gears 368 are formed on a plurality of third drive force transfer shafts 369 to be engaged with the worms 366 and the first rotation gear 342 formed on the rotational shafts 369 of the respective developer cartridges 295Y, 295M, 295C and 295K.

Figure 12:
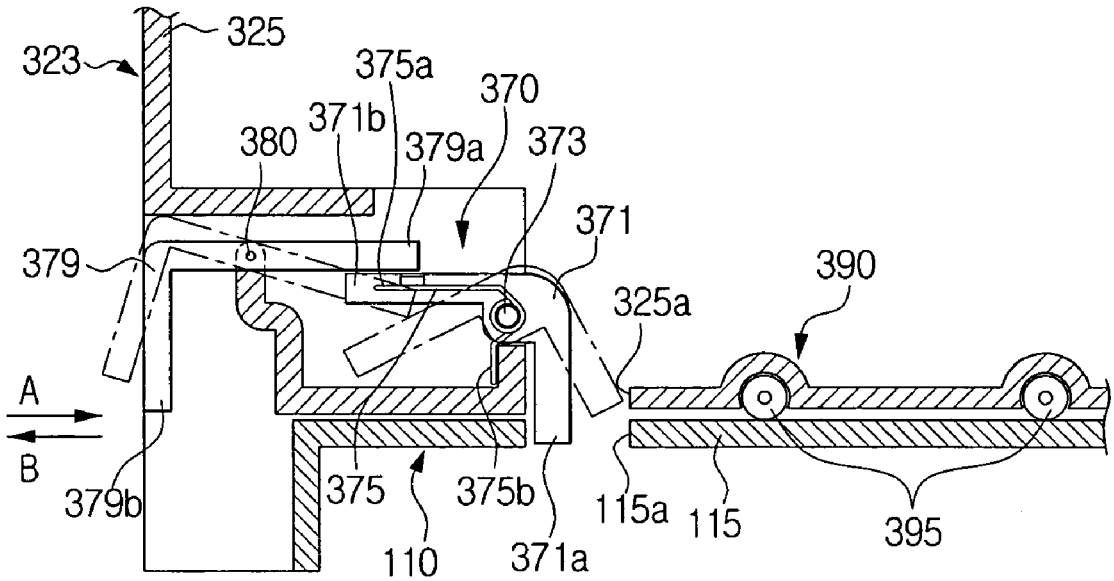
FIG. 12 is an elevational view in partial cross section of a lock part and a guide part of the color image forming process module of FIG. 4

Referring to FIG. 12, the image forming process module 200 further includes a lock part 370 for locking the image forming process module 200 when the image forming process module 200 is mounted on the main frame 110 of the main body 101.

The lock part 370 includes a hook member 371, an elastic member 375 and an operation member 379.

The hook member 375 is formed on a first rotational shaft 373 of the cartridge fixing part 325 to move between a first position (a solid line in FIG. 12) and a second position (dotted line in FIG. 12), wherein the hook member 375 is inserted in a fixing hole 115*a* of a middle plate 115 of the main frame 110 through a penetration hole 325*a* of the cartridge fixing part 325 of the fixing frame 110 on the first position, and the hook member 375 is disposed away from the fixing hole 115*a* on the second position. The hook member 371 includes a first end portion 371*a* inserted into the fixing hole 115*a* or disposed away from the fixing hole 115*a* and a second end portion 371*b* being in contact with an operation end of the operation member 379.

The elastic member 375 elastically pushes the hook member 371 so that the hook member 371 is kept in the first position and is installed to the first rotational shaft 373. The elastic member 375 is preferably a torsion spring having an end 375*a* fixed to the hook member 371 and the other end 375*b* supported by a fixed bracket of the cartridge fixing part 325.

The operation member 379 separates the hook member 371 from the fixing hole 115*a* and moves it to the second position. The operation member 379 is rotatably installed to a second rotational shaft 380. The operation member 379 has the operation end 379*a* in contact with the second end portion 371*b* of the hook member 371 and a handle 379*b* to be held by a user.

The image forming process module 200 further includes a guide part 390 for guiding the motion of the image forming process module 200 when the image forming process module 200 is mounted on the main frame 110 or separated from the main frame 110. The guide part 390 includes a plurality of rotational rollers 395 installed to rotate around the cartridge fixing part 325 at regular intervals. Accordingly, when the image forming process module 200 is attached to the main frame 110 or separated from the main frame 110, the rotational roller 395 is guided to the middle plate 115 of the main frame 110 and rotates so that the image forming process module 200 may be smoothly mounted to and detached from the main frame 110.

Figure 13:
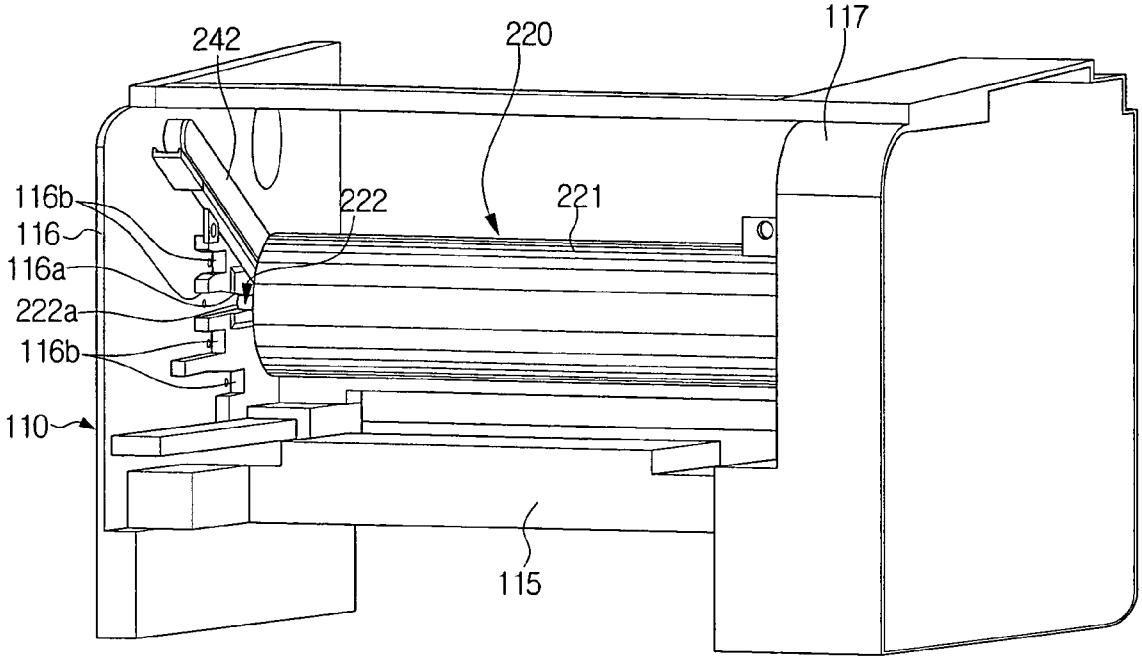
FIG. 13 is a perspective view of the coupling structure of a photoreceptor of the photoreceptor unit and a main frame.

As such, referring to FIG. 13, to mount the image forming process module 200, in which the photoreceptor unit 220 and the development unit 290 are integrated, to the main frame 110, the main frame 110 has shaft reception grooves 116*a* and 116*b* on a first side wall 116 thereof for receiving an end portion 222*a* of a shaft 222 of the photoreceptor 220 and an end portion of a shaft 298*a* of a development roller 298 of each development assembly 295Y, 295M, 295C and 295K of the development unit 290.

The main frame 110 further has a drive gear train 108 on a second side wall 117, wherein the drive gear train 108 is connected to the development assembly gear train (275 in FIG. 8B) formed at the other end portion of the shaft 298*a* of each of the development rollers 298 of the developments assemblies 295Y, 295M, 295C and 295K of the development unit 290 and to the photoreceptor gear train formed at the other end portion 222*b* of the shaft 222 of the photoreceptor 221.

Accordingly, referring to FIG. 12, when mounting the image forming process module 200 on the main frame 110, when an outer door (102 in FIG. 2) is opened and then the image forming process module 200 is mounted on the middle plate 115 of the main frame 110, the first end portion 371*a* of the hook member 371 of the lock part 370 is disposed in the second position by being pushed by the middle plate 115 and retreated inside the penetration hole 325*a*.

Figure 14:
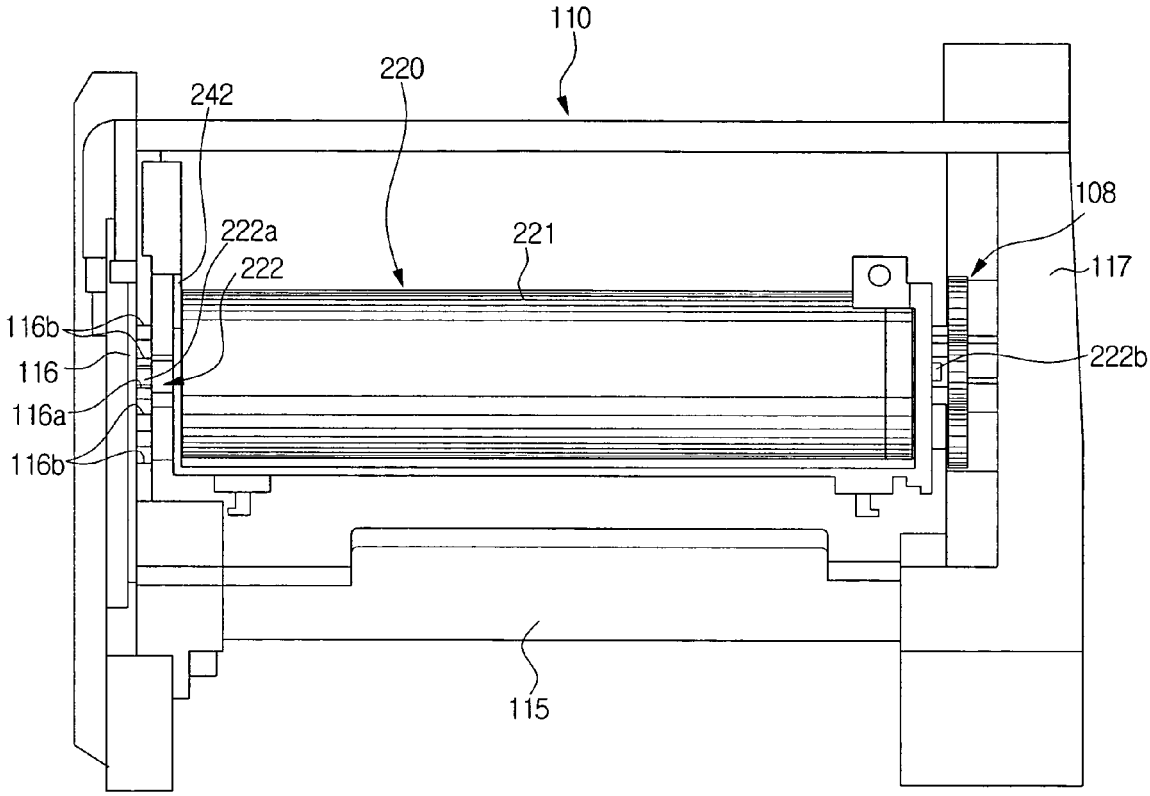
FIG. 14 is a front elevational view of the coupling structure of the photoreceptor of the photoreceptor unit of the color image forming process module and the main frame.

Referring to FIG. 3, when the image forming process module 200 is completely mounted on the main frame 110 by being pushed in the direction of an arrow A on the middle plate 115 of the main frame 110, referring to FIGS. 13 and 14, the one end portion 222*a* of the shaft 222 of the photoreceptor 221 and the one end portion of the shaft 298*a* of the development roller 298 of each of the development assemblies 295Y, 295M, 295C and 295K of the development unit 290 are inserted into the shaft reception grooves 116*a* and 116*b*; and the photoreceptor gear train formed at the other end portion 222*b* of the shaft 222 of the photoreceptor 221 and the development gear train 275 formed at the other end portion of the shaft 298*a* of the development roller 298 of each of the development assemblies 295Y, 295M, 295C and 295K of the development unit 290 are connected to the drive gear train 108.

The penetration hole 325*a* of the cartridge fixing part 325 and the fixing hole 115*a* of the middle plate 115 of the main frame 110 are aligned with each other. As a result, the first end portion 371*a* of the hook member 371 is moved to the first position in which the first end portion 371*a* is inserted in the fixing hole 115*a* and the penetration hole 325*a* by an elastic force of the elastic member 375, and the image forming process module 200 is locked in the main frame 110.

On the contrary, when the image forming process module 200 is removed from the main frame 110, if the handle 379*b* of the operation member 379 is pulled in the direction of the arrow B, the operation member 379 rotates clockwise on the second rotational shaft 380 and the second end portion 379*b* of the operation member 379 presses down the second end portion 371*b* of the hook member 371. As a result, the hook member 371 is moved to the second position, that is, the first end portion 371*a* of the hook member 371 is separated from the fixing hole 115*a*, and the locking of the image forming process module 200 is released.

When a user further pulls the image forming process module 200, the image forming process module 200 is taken out of the main frame 110 and separated from the main frame 110.

Referring to FIG. 2, around the outer edge of the photoreceptor 221, the electrification unit 112, the LSU 121, the charge removing unit 187 and the image transfer unit 140 are disposed at predetermined positions along the rotating direction of the photoreceptor 221.

The electrification unit 112 includes a scorotron electrifier disposed away from the surface of photoreceptor 221 by a distance, and is applied with a predetermined electrification bias voltage, thereby forming a predetermined potential on the surface of the photoreceptor 221.

The LSU 121 irradiates a laser beam to the surface of the photoreceptor 221 electrified with a predetermined potential using a laser diode according to an image signal input thereto from a computer or a scanner, thereby forming a latent image having a low potential portion that has a potential lower than the electrification potential.

The charge removing unit 187 removes an electrified potential on the surface of the photoreceptor 221 and includes a charge removing lamp.

The image transfer unit 140 transfers a developer image formed on the photoreceptor 121 to an image reception medium P, and includes an image transfer belt 141, a transfer voltage application member 142 and a transfer roller 149.

The image transfer belt 141 transfers the developer image formed on the photoreceptor 121 to the image reception medium P, and is installed to rotate in a medium transfer direction (clockwise in FIG. 2) by a drive roller 143, a tension roller 144 and a passive roller 145.

An organic photoconductive layer is preferably coated on the image transfer belt 141 so that the color developer image may be transferred.

A belt cleaning unit (not shown) is provided to clean waste developer remaining on the image transfer belt 141 after the image transfer belt 141 transfers the color developer image onto the image reception medium P. The belt cleaning unit may include a belt cleaning blade for cleaning the image transfer belt 141 and a waste developer storage vessel for collecting waste developer removed by the belt cleaning blade.

The transfer voltage application member 144 is applied with a first transfer bias voltage by a transfer bias voltage supply unit (not shown) to make the color developer image formed on the photoreceptor 221 be transferred to the image transfer belt 141.

The transfer roller 149 transfers the color developer image on the image transfer belt 141 onto the image reception medium P, and is arranged to press the image reception medium P against the drive roller 143 at a predetermined pressure. The transfer roller 149 is applied with a second transfer bias voltage by the transfer bias voltage supply unit to make the color developer image on the image transfer belt 141 be transferred onto the image reception medium P.

The fixing unit 180 fixes the color developer image transferred onto the image reception medium P, and includes a heat roller 181 and a press roller 183. The heat roller 181 includes a heater (not shown) to make the color developer image be fixed on the image reception medium P by heat at a high temperature. The press roller 183 is installed to press the image reception medium P by an elastic press device (not shown).

The paper discharge unit 190 discharges the image reception medium P on which the developer image is fixed to a discharge tray 194, and includes a discharge roller 191 and a back-up roller 193.

As stated above, the image forming process module 200 in which the color developer image on the photoreceptor 221 is not directly transferred to the image reception medium P, but indirectly transferred to the image reception medium P via the image transfer belt 141 is exemplified but this invention is not limited thereto. That is, the image forming process module 200 may be applied to a color image forming apparatus (not shown) in which the color developer image on the photoreceptor 221 is directly transferred to the image reception medium P.

Further, in the exemplary embodiment as stated above, a color electro-photographic printer 100 for performing a single face printing is exemplified, but this invention is also applicable to a color image forming apparatus (not shown) capable of performing double faced printing.

The operation of the electro-photographic color printer 100 according to an exemplary embodiment of the present invention is described in detail below with reference to FIG. 2 to FIG. 14.

First, when a print command is generated, the photoreceptor 221 rotates continuously by the photoreceptor drive motor. As a result, the surface of the photoreceptor 221 is electrified uniformly by the electrification unit 112.

Next, the surface of the photoreceptor 221 is exposed to light by the LSU 121, thereby forming a first color latent image, for example a yellow electrostatic latent image.

Next, a front end portion of the yellow electrostatic latent image reaches a development position, the development roller 298 of the yellow development assembly 295Y is supplied with a development bias voltage by the development bias voltage supply unit.

As a result, the yellow electrostatic latent image is developed to a continuous yellow developer image by a yellow developer supplied from the yellow developer cartridge 330Y by the development roller 298 of the yellow development assembly 295Y.

Referring to FIGS. 8A, 8B, 10 and 11, the yellow developer is dropped onto the developer transfer belt 312 disposed under the introduction hole 306*a* of the developer introduction part 306 of the yellow development assembly 295Y from the discharge hole 333*a* of the developer discharge part 333 of the yellow developer cartridge 330Y by the mixing member 339 driven by the cartridge drive force transfer part 360. The yellow developer dropped onto the developer transfer belt 312 is transferred to the first developer transfer auger 314 by the scooper 319, and then supplied to the developer supply roller 302 as the first and second developer transfer augers 314 and 316 move in the directions of the arrows C and D.

After a yellow developer image is completely formed and a rear end of the yellow image passes through the development position, the development bias voltage applied to the development roller 298 of the yellow development assembly 295Y is intercepted by the development bias voltage supply unit.

At this time, the yellow developer image formed on the photoreceptor 221 passes the transfer unit 140 being in non-operation status, the charge removing unit 187 and the photoreceptor cleaner 230 in turn and finally disposed under the electrification unit 112 again. Particularly, the image transfer belt 141 of the transfer unit 140 and the cleaning member 231 of the photoreceptor cleaner 230 are kept in the non-contact status by a tension roller transfer device (not shown) and a solenoid 233 except during the operation status.

The photoreceptor 221 having the yellow developer image is disposed under the electrification unit 112 and electrified uniform again by the electrification unit 112, and a second color latent image, for example a magenta electrostatic latent image, is exposed and overlapped with the yellow image.

Next, when a front end of the magenta electrostatic latent image reaches the development position of the magenta development assembly 295M, the development roller 298 of the magenta development assembly 295M is supplied with a development bias voltage by the development bias voltage supply unit.

As a result, the magenta electrostatic image is developed to form a magenta developer image which continues from the front end to a rear end of the magenta latent image by the development roller 298 of the magenta development assembly 295M.

After the magenta developer image is formed and the rear end of the magenta developer image passes the magenta development position, the development bias voltage to be supplied to the development roller 298 of the magenta development assembly 295M is intercepted by the development bias voltage supply unit.

Next, cyan and black developer images are formed and overlapped on the previously formed developer images, so that a color developer image is finally formed on the photoreceptor 221.

The color developer image formed on the photoreceptor 221 is transferred onto the image transfer belt 141 by the first transfer voltage supplied by the transfer voltage application member 142 of the transfer unit 140.

Next, a potential of the photoreceptor 221 is removed by the charge removing unit 187, and waste developer remaining on the photoreceptor 221 is removed by the cleaning member 231 of the photoreceptor cleaner 230 which is driven by the solenoid 233, so that the photoreceptor 221 is restored to the initial status.

Referring to FIG. 5, the waste developer removed by the cleaning member 231 is moved to a side of the waste developer collector 236 by the waste developer transfer auger 240 disposed in the waste developer collector 236, transferred to the waste developer introduction hole 266 of the waste developer storage tank 265 by the first scooper 253 of the waste developer transfer belt 250 and stored in the waste developer storage tank 265 after being dropped from the introduction hole 266. When the waste developer storage tank 265 is full, the waste developer storage tank 265 is separated from the bottom plate 181 of the fixing frame 280 by separating the introduction hole 266 from the connection pipe line 242, emptied and then reinstalled onto the bottom plate 181 instead of separating the entire image forming process module 200 from the main frame 110. Alternatively, the separated waste developer storage tank 265 is discarded and is replaced with a new one.

The color developer image transferred to the image transfer belt 141 is transferred onto the image reception medium P, which is picked up by the pick-up roller 113 and fed by the resistor roller 114 from the paper feeding cassette 111, by a second transfer voltage and a pressure supplied by the transfer roller 149.

The color developer image is fixed onto the image reception medium P by heat and pressure applied by the heat roller 181 and the press roller 183 after the image reception medium P having the color developer image thereon is transferred to the fixing unit 180. The image reception medium P is then discharged to the paper discharge tray 194 by the paper discharge roller 191 and the back-up roller 193 of the paper discharge unit 190.

As described above, the image forming process module and the image forming apparatus according to an exemplary embodiment of the present invention are structured such that the image forming process module in which the photoreceptor unit and the development unit having a plurality of development assemblies are integrated is detachably installed to the main frame of the main body. Accordingly, the image forming process module and the image forming apparatus according to an exemplary embodiment of the present invention has the enhanced assembly and replacement efficiencies when assembling and replacing the photoreceptor and the development unit. Furthermore, the image forming process module and the image forming apparatus according to an exemplary embodiment of the present invention may be easily manufactured and realized in a compact size.

Furthermore, because a plurality of developer cartridges are detachably installed in the development unit, the developer may be easily refilled by opening an external door and simply replacing the developer cartridge without separating the entire image forming process module from the main frame of the main body. Accordingly, the image forming process module and the image forming apparatus according to an exemplary embodiment of the present invention has the enhanced developer refill efficiency.

Still furthermore, because the waste developer storage tank of the photoreceptor unit is detachably installed to the fixing frame, waste developer in the waste developer storage tank may be easily removed and discarded when the waste developer storage tank is full, by simply separating only the waste developer storage tank, instead of separating the entire image forming process module from the main frame.

While the invention has been shown and described with reference to certain embodiments thereof, it will be understood by those skilled in the art that various changes in form and details may be made therein without departing from the spirit and scope of the invention as defined by the appended claims.

What is claimed is:

1. An image forming process module for an image forming apparatus, comprising:

a photoreceptor unit having at least one photoreceptor on which an electrostatic latent image is formed;

a development unit installed around the outer surface of the photoreceptor and including a plurality of development assemblies that develop the latent image to form a visual image;

a fixing frame detachably installed to a main body of the image forming apparatus for fixing the photoreceptor unit and the development unit to be integrated into a single module; and a waste developer storage tank detachably installed to the fixing frame for storing waste developer, the waste developer storage tank being removable while the fixing frame is installed to the main body of the image forming apparatus.

2. The image forming process module according to claim 1, wherein the photoreceptor unit has a photoreceptor cleaner for cleaning the photoreceptor.

3. The image forming process module according to claim 2, wherein the photoreceptor cleaner includes a cleaning member for cleaning the surface of the photoreceptor; and a waste developer storage part for storing waste developer generated as the cleaning member cleans the photoreceptor.

4. The image forming process module according to claim 3, wherein the waste developer storage part includes a waste developer collector installed under a side of the photoreceptor for collecting waste developer removed by the cleaning member; and a waste developer transfer member for transferring the waste developer collected in the waste developer collector to the waste developer storage tank.

5. The image forming process module according to claim 4, wherein the waste developer transfer member includes a waste developer transfer auger for moving the waste developer collected in the waste developer collector to a side of the waste developer collector;

a connection pipe line for connecting the waste developer collector with the waste developer storage tank; and a waste developer transfer belt installed in the connection pipe line for transferring the waste developer from the waste developer collector to the waste developer storage tank.

6. The image forming process module according to claim 1, wherein a developer cartridge unit has a plurality of developer cartridges, each of which contains a different color developer from each other and each is detachably installed to a cartridge fixing part fixed to the fixing frame to be connected to each corresponding development assembly.

7. The image forming process module according to claim 6, wherein each of the developer cartridges includes a storage vessel that contains a developer and has a developer discharge part that discharges the developer to the corresponding development assembly;

a rotational shaft rotatably supported by the storage vessel; and a mixing member for mixing the developer in the storage vessel.

8. The image forming process module according to claim 7, wherein each of the development assemblies has a developer transfer member for transferring a developer discharged from the developer discharge part of the storage vessel to a developer supply roller.

9. The image forming process module according to claim 8, wherein the developer transfer member includes a developer transfer belt for transferring a developer dropped from the developer discharge part of the storage vessel to the developer supply roller; and at least one developer transfer auger installed between the developer supply roller and the developer transfer belt for transferring a developer in a lengthwise direction of the developer supply roller.

10. The image forming process module according to claim 7, wherein the developer cartridge unit has a cartridge drive force transfer part for transferring a drive force to the rotational shaft of each developer cartridge.

11. The image forming process module according to claim 10, wherein the cartridge drive force transfer part includes a first drive force transfer gear engaged with a drive gear train installed to the main body;

a second drive force transfer gear engaged with the first drive force transfer gear;

a plurality of worms formed on the same shaft of the second drive force transfer gear; and a plurality of worm gears engaged with the worms and corresponding rotation gears formed on the rotational shafts of the developer cartridges, respectively.

12. The image forming process module according to claim 1, wherein a lock part for locking the image forming process module to the main body of the image forming apparatus when the image forming process module is mounted in the main body of the image forming apparatus.

13. The image forming process module according to claim 12, wherein the lock part includes a hook member installed in the fixed frame such that the hook member moves between a first position at which it is inserted in a fixing hole of the main body and a second position at which it is separated from the fixing hole;

an elastic member that elastically presses the hook member so that the hook member is kept in the first position; and an operation member for moving the hook member to the second position so that the hook member is separated from the fixing hole.

14. The image forming process module according to claim 1, wherein a guide part guides a motion of the image forming process module when the image forming process module is mounted in or separated from the main body of the image forming apparatus.

15. The image forming process module according to claim 14, wherein the guide part includes a plurality of rotation rollers rotatably installed on the bottom of the fixing frame.

16. An image forming apparatus, comprising:

a main frame constituting a main body; and an image forming process module including a photoreceptor unit having a photoreceptor on which an electrostatic latent image is formed;

a development unit installed around an outer edge portion of the photoreceptor and having a plurality of development assemblies for developing the electrostatic latent image and forming a visual image;

a fixing frame detachably installed to the main frame for fixing the photoreceptor unit and the development unit to be integrated into a single module; and a waste developer storage tank detachably installed to the fixing frame for storing waste developer, the waste developer storage tank being removable while the fixing frame is installed to the main frame of the image forming apparatus.

17. The image forming apparatus according to claim 16, wherein the photoreceptor unit has a photoreceptor cleaner for cleaning the photoreceptor.

18. The image forming apparatus according to claim 17, wherein the photoreceptor cleaner includes a cleaning member for cleaning the surface of the photoreceptor; and a waste developer storage part for storing waste developer generated as the cleaning member cleans the photoreceptor.

19. The image forming apparatus according to claim 18, wherein the waste developer storage part includes a waste developer collector installed under a side of the photoreceptor for collecting waste developer removed by the cleaning member; and a waste developer transfer member for transferring the waste developer collected in the waste developer collector to the waste developer storage tank.

20. The image forming apparatus according to claim 19, wherein the waste developer transfer member includes a waste developer transfer auger for moving the waste developer collected in the waste developer collector to a side of the waste developer collector;

a connection pipe line for connecting the waste developer collector with the waste developer storage tank; and a waste developer transfer belt installed in the connection pipe line for transferring the waste developer from the waste developer collector to the waste developer storage tank.

21. The image forming apparatus according to claim 16, wherein a developer cartridge unit has a plurality of developer cartridges, each of which contains a different color developer from each other and each is detachably installed to a cartridge fixing part fixed to the fixing frame to be connected to each corresponding development assembly.

22. The image forming apparatus according to claim 21, wherein each of the developer cartridges includes a storage vessel that contains a developer and has a developer discharge part that discharges the developer to the corresponding development assembly;

a rotational shaft rotatably supported by the storage vessel; and a mixing member for mixing the developer in the storage vessel.

23. The image forming apparatus according to claim 22, wherein each of the development assemblies has a developer transfer member for transferring a developer discharge from the developer discharge part of the storage vessel to a developer supply roller.

24. The image forming apparatus according to claim 23, wherein the developer transfer member includes a developer transfer belt for transferring a developer dropped from the developer discharge part of the storage vessel to the developer supply roller; and at least one developer transfer auger installed between the developer supply roller and the developer transfer belt for transferring a developer in a lengthwise direction of the developer supply roller.

25. The image forming process module according to claim 22, wherein the developer cartridge unit has a cartridge drive force transfer part for transferring a drive force to the rotational shaft of each developer cartridge.

26. The image forming process module according to claim 25, wherein the cartridge drive force transfer part includes a first drive force transfer gear engaged with a drive gear train installed to the main body;

a second drive force transfer gear engaged with the first drive force transfer gear;

a plurality of worms formed on the same shaft of the second drive force transfer gear; and a plurality of worm gears engaged with the worms and corresponding rotation gears formed on the rotational shafts of the developer cartridges, respectively.

27. The image forming process module according to claim 16, wherein a lock part locks the image forming process module to the main body of the image forming apparatus when the image forming process module is mounted on the main body of the image forming apparatus.

28. The image forming process module according to claim 27, wherein the lock part includes a hook member installed in the fixed frame such that the hook member moves between a first position at which it is inserted in a fixing hole of the main body and a second position at which it is separated from the fixing hole;

an elastic member that elastically presses the hook member so that the hook member is kept in the first position; and an operation member for moving the hook member to the second position so that the hook member is separated from the fixing hole.

29. The image forming process module according to claim 16, wherein a guide part guides a motion of the image forming process module when the image forming process module is mounted on or separated from the main body of the image forming apparatus.

30. The image forming process module according to claim 29, wherein the guide part has a plurality of rotation rollers rotatably installed on the bottom of the fixing frame.

* * * * *